United States Patent [19]

Stoner

[11] Patent Number: 4,790,231

[45] Date of Patent: Dec. 13, 1988

[54] LIGHTWEIGHT BELT LINK FOR TELESCOPED AMMUNITION AND BELT FORMED THEREFROM

[75] Inventor: Eugene M. Stoner, Palm City, Fla.

[73] Assignee: ARES, Inc., Port Clinton, Ohio

[21] Appl. No.: 110,044

[22] Filed: Oct. 13, 1987

Related U.S. Application Data

[63] Continuation of Ser. No. 774,160, Sep. 9, 1985, abandoned.

[51] Int. Cl.[4] ..... F42B 39/08

[52] U.S. Cl. ..... 89/35.02

[58] Field of Search ..... 89/35.01, 35.02; 102/433, 434

[56] References Cited

U.S. PATENT DOCUMENTS

| | | | |
|---|---|---|---|
| 2,022,685 | 12/1935 | Moore | 89/35.02 |
| 2,401,050 | 5/1946 | Cooper et al. | 89/35.02 |
| 2,708,390 | 5/1955 | Darsie | 89/35.02 |
| 3,547,001 | 12/1970 | Stoner | 102/433 |
| 4,335,657 | 6/1982 | Bains | 102/433 |

FOREIGN PATENT DOCUMENTS

| | | | |
|---|---|---|---|
| 36603 | 3/1909 | Austria | 89/35.02 |
| 202937 | 10/1908 | Fed. Rep. of Germany | 89/35.01 |
| 1158409 | 11/1963 | Fed. Rep. of Germany | 89/35.01 |
| 1385924 | 12/1964 | France | 89/35.01 |

*Primary Examiner*—Stephen C. Bentley

*Attorney, Agent, or Firm*—Allan R. Fowler

[57] ABSTRACT

A lightweight ammunition belt link comprises first, second and third elongate, tubular shell holding rings sized to slidingly receive cylindrical, telescoped amunition. First and second webs interconnect the three shell-holding rings so that the first and second rings are axially spaced apart on a first longitudinal axis and the third ring is on a second longitudinal axis, which is laterally separated from the first axis by slightly over one shell diameter, the third ring is offset between the first and second rings which are spaced apart so that in forming the ammunition belt, the third ring of one link fits between, the first and second rings of a next link, and can be axially aligned therewith. A shell installed into the first and second ring of one link and the interposed third ring of an adjacent link connects the two links together and forms a pivot point enabling one link to hinge around the adjacent link for belt storage. The links include a detent which engages a shell groove to releasably retain the shells in the links. The links are preferably formed of a thermoplastic material such as LEXAN brand thermoplastic for light weight and high strength.

7 Claims, 2 Drawing Sheets

LIGHTWEIGHT BELT LINK FOR TELESCOPED AMMUNITION AND BELT FORMED THEREFROM

This application is a continuation of application Ser. No. 06/774,160, filed 09/09/85, now abandoned.

BACKGROUND OF THE INVENTION

1. Field of the Invention

The present invention relates generally to shell feeding apparatus for automatic guns and more particularly to ammunition feed belts of the disentegrating, link type for use with machine guns, automatic cannon and the like and to links therefor.

2. Discussion of the Prior Art

Many types of automatic guns are provided for military services throughout the world. Such guns range in size from handheld automatic rifles and sub-machine guns, through machine guns, to large automatic cannon. Because these weapons must obviously be fed shells for firing, many associated types of shell feeding apparatus are also produced for military services. Shell storage provision may be incorporated into such shell feeding apparatus; alternatively, the feeding apparatus may be configured for transporting shells from a shell supply to the associated gun for firing.

Frequently, automatic guns have a natural or inherent cycling rate which is potentially faster than the rate at which shells can be fed to the gun; although, obviously no gun can actually be fired at a faster rate than the shell feeding rate. Because the rate at which shells can be reliably fed to a gun thus often determines the maximum firing rate of the gun, considerable attention is directed towards feeder design and construction to enhance gun performance.

By way of example, most small, hand held automatic (or semi-automatic) weapons are fed shells from linear or drum magazines. Springs, acting on shells in the magazines, push the shells towards a magazine feed port from which the gun bolt group extracts a shell on counterrecoil movement, and through which shells are loaded into the magazine. The ability of the springs to reliably advance shells in the magazine, regardless of the number of shells generally limits the maximum number of shells a particular magazine can hold, with magazines for larger caliber shells typically holding fewer shells than magazines for small caliber shells. By way of further example, large automatic or automated cannon are ordinarily fed from an associated shell supply by a shell transfer apparatus, which may typically comprise some type of conveyor. For some such shell feeding apparatus, the shell supply may, itself,include a shell conveyor in which the shells are stored and by means of which,during gun firing, the shells are advanced to a transfer position from which they are subsequently conveyed by the feeder to the gun.

More relevantly, intermediate sized guns, including machine guns and smaller caliber automatic cannon (for example, up to about 35 mm size) are mos commonly fed shells by means of flexible ammunition belts. Such belts are connected to feeder portions of the associated gun, being advanced into the gun in response to firing. Flexible ammunition belts used with most early models of machine guns were generally constructed of canvas or fabric webbing with a series of loops provided along the belt for holding the shells. These belts remained intact when shells were extracted from the loops, the belt being fed through the guns as shells are fired. Although such fabric belts could be reloaded for reuse, various disadvantages, which may, for example, include problems of the empty belts being entangled with the gun or other equipment and tearing of, or damage to, the belts. Such problems have led to the almost universal use of ammunition belts constructed of a large number of individual, rigid belt links which may be joined together by shells held by the belt or which may be configured for separately being connected together. In the former situation, extraction of the shells causes the links to be disengaged from one another and in the latter situation delinking apparatus associated with the gun are typically used for link disengagement. In any event, as shells are extracted from the belt for firing, the belt disintegrates link-by-link so that there is in fact, no empty section of belt. Ordinarily the links are discharged from the gun with, or separately from, fired shell casings and are disposed of therewith. The individual links thus may be discharged overboard, for example, from a vehicle or aircraft, with the shell casings.

In addition to elimination of empty belt problems, the links of disintegratable ammunition belts, being generally quite rigid, importantly provide both more secure shell retention and more uniform shell positioning in the belt than is generally provided by web belts. As an illustration, if a shell accidentally falls out of an ammunition belt, the gun stops firing when the empty shell position of the belt is reached. Also, if a shell is partially out of its required position, feeding of the belt into the gun may be jammed.

Typically, both continuous web and linked ammunition belts have heretofore been concerned only with the carrying and feeding of conventional, tapered casing shells of the type used throughout the world for the past many decades. Because of the casing taper, such shells cannot ordinarily be pushed through the belt loop or links and shell extraction thus requires the shells to be pulled rearwardly out of the belts. Thereafter, the shells must, of course, be moved back forwardly a least about two shell lengths before the shell is fully chambered for firing, a long gun operating stroke thereby being necessary which limits the cycling and the firing rate.

Alternatively, some few types of belt links are provided which only partly encircle the shells held thereby. Delinkers may then be provided which expand the links and enable the shells to be extracted sidewardly from the links.

Regardless of the type of links used for disintegratable ammunition belts, the links, being generally considered as expendable, must be relatively inexpensive to be practical. It should not, as an example, be the case that the links are more costly than the shells held thereby. Moreover, the links should be comparatively light in weight, since in most military weapons systems, including the available ammunition, weight is important. Still further, the links must be sufficiently strong to support the weight of a fully loaded belt and to withstand belt advancing stresses. The links must be sufficiently rigid to prevent belt entanglement while at the same time must be sufficiently flexible to permit the amount of belt twisting and "fanning" needed for gun movement and to permit belt folding for storage in ammunition boxes. Yet another requirement is that the links be relatively small so that only a minimum amount of ammunition storage space is lost by use of the links. As a result, for reliable shell feeding, particularly in fast firing guns requiring fast shell feeding, proper belt link design is very important.

Link configuration for disintegratable ammunition belts is, of course, affected by ammunition configuration. Currently, there exists considerable interest, in at least some segments of the military in many countries, including the United States, in the redesign of shells. Such shell redesign would provide non-tapered, completely cylindrical shell casings into which the projectiles are fully recessed, in contrast with conventional shells in which the casings are both tapered and necked-down and from which the projectile portion protrudes. Although such cylindrical shells are, because of the recessed projectile, larger in diameter than conventional shells of the same caliber, they are substantially shorter in length.

Actual or potential advantages of the cylindrical, telescoped shells are the easier and more efficient shell storage and the easier shell handling during feeding, including the ability to feed the shells forwardly through a firing chamber. On the other hand, advantages of conventional, tapered and necked-down shell casings are that forward shell movement control is enabled and forward movement can be limited, for example, when such shells are chambered into the breech of a gun for firing.

In any event, the use of cylindrical, telescoped shells requires that new belt links be provided for belted ammunition. It is, therefore, an object of the present invention to provide a belt link for a disintegrating ammunition belt which is especially configured for holding cylindrical shells.

Another object of the present invention is to provide a lightweight, comparatively inexpensive plastic belt link for use with cylindrical shells.

Still another object of the present invention is to provide a belt link for a disintegrating ammunition belt, especially for cylindrical shells which uses one of the shells to interconnect adjacent belt links together and which enables the links to pivot about the shells so that a belt constructed of a number of the links can be doubled back upon itself for belt storage.

Other objects, features and advantages of the present invention will be readily apparent from the following detailed description, when taken in conjunction with the accompanying drawings.

SUMMARY OF THE INVENTION

In accordance with the present invention, a disintegratable ammunition belt link for holding cylindrical, telescoped shells comprises first, second and third rings, each of which have an inner diameter sized to slidingly receive a cylindrical shell of a particular caliber and means for interconnecting the first, second and third rings together with the first and second rings axially aligned, and spaced apart on a first longitudinal axis a distance at least as great as the axial length of the third ring and with the third ring axially aligned along a second longitudinal axis parallel to, and spaced apart in excess of one shell diameter from the first longitudinal axis, and with the third ring aligned between the first and second rings. The wall thicknesses of the first, second and third rings are such as to permit the simultaneous axial insertion of one of the shells into the first and second rings and another one of the shells into the third ring. Preferably the third ring is configured relative to, and is so interconnected with, the first and second rings as to limit axial movement of one link relative to an adjacent link when the third ring of one link is positioned between the first and second rings of the adjacent link and a shell is axially inserted therethrough to hold the two links together. The distance between remote axial ends of the first and second rings, that is, the overall axial length of the link, is preferably less than the axial length of the shells held by the links The belt of linked ammunition comprises a plurality of telescoped cylindrical ammunition shells, each having an annular recess formed in the cylindrical surface thereof adjacent the forward end thereof, and a plurality of plastic links interconnected by said cylindrical shells. Each link has first, second and third rings, and each ring defines a smooth cylindrical interior surface of the same interior diameter. This interior diameter is in excess of the exterior diameter of the cylindrical ammunition shells. Thus, the shells may be pushed forward through the rings without the rings binding thereon.

The first ring of each link terminates, at its forward extremity, in a forward facing annular surface.

Each link also has web means connecting and spacing the rings of the link, such that the first and second rings are spaced apart on one side of the web means and have a common axis for their interior cylindrical surfaces. The third ring is disposed centrally on the other sides of the web means, with the interior cylindrical surface thereof being axially parallel to and at a spaced apart location from the common axis of the first and second rings.

The third ring of each link fits between the first and second rings of each adjacent link in the belt. This provides an interior surface in registration with the interior surfaces of the first and second rings.

The links are interconnected into a belt by the interposition of the cylindrical ammunition shells within the registered cylindrical surfaces of the rings of adjacent links.

Each link has detent means protruding from the cylindrical interior surface of the first ring of the link. The detent means is disposed adjacent the forward facing annular surface of the first ring, and is in engagement with the annular recess formed in the surface of the associated cylindrical ammunition shell. Thus, the ammunition shell can be rammed forward out of the links without producing excessive distortion of the plastic links and consequent binding of the shell by the links.

Preferably, the detent means comprises a relatively small upstanding tab which protrudes radially inward from the cylindrical interior surface of the first ring.

It is also desirable, in order to facilitate loading and pushing of an associated ammunition round through the registered rings of the links, that the tab be beveled on its surface interior of the first ring, and that the annular recess be beveled in the same direction as the tab on the first ring of the asosciated link.

The links may conveniently have rings which further define a smooth cylindrical exterior surface, of a common exterior diameter.

The web of each link may extent from the exterior cylindrical surface of the first and second rings to the exterior cylindrical surface of the third ring. In this situation, the axial length of the portion of the third ring opposite the web should be sufficiently reduced from the separation distance between facing surfaces of the first and second rings as to prevent binding of the third ring on the web of the adjacent link.

When the shells are formed with an annular indexing groove around the outside thereof, preferably adjacent the projectile end thereof, each belt link correspondingly includes means for engaging the shell groove when one of the shells is axially inserted into the link along one of the first and second axes. The shell groove engaging means preferably comprising a detent on the link first ring, the detent being preferably positioned so that when a shell is inserted into the first and second rings until the detent engages the shell groove, the first ring is relatively adjacent to the shell projectile end. Preferably the links are constructed of a thermoplastic material, the plastic of preference being LEXAN brand thermoplastic.

An elongate ammunition belt is constructed of a number of the described belt links, each adjacent pair of links being held together by one of the shells. The shells holding adjacent links of the ammunition belt together function as pivot pins enabling great longitudinal flexibility of the belt which permits tight folding of the belt for storage in ammunition boxes.

BRIEF DESCRIPTION OF THE DRAWINGS

A better understanding of the present invention may be had from a consideration of the following detailed description taken in conjunction with the accompanying drawings in which.

DESCRIPTION OF THE PREFERRED EMBODIMENT

Figure 1:
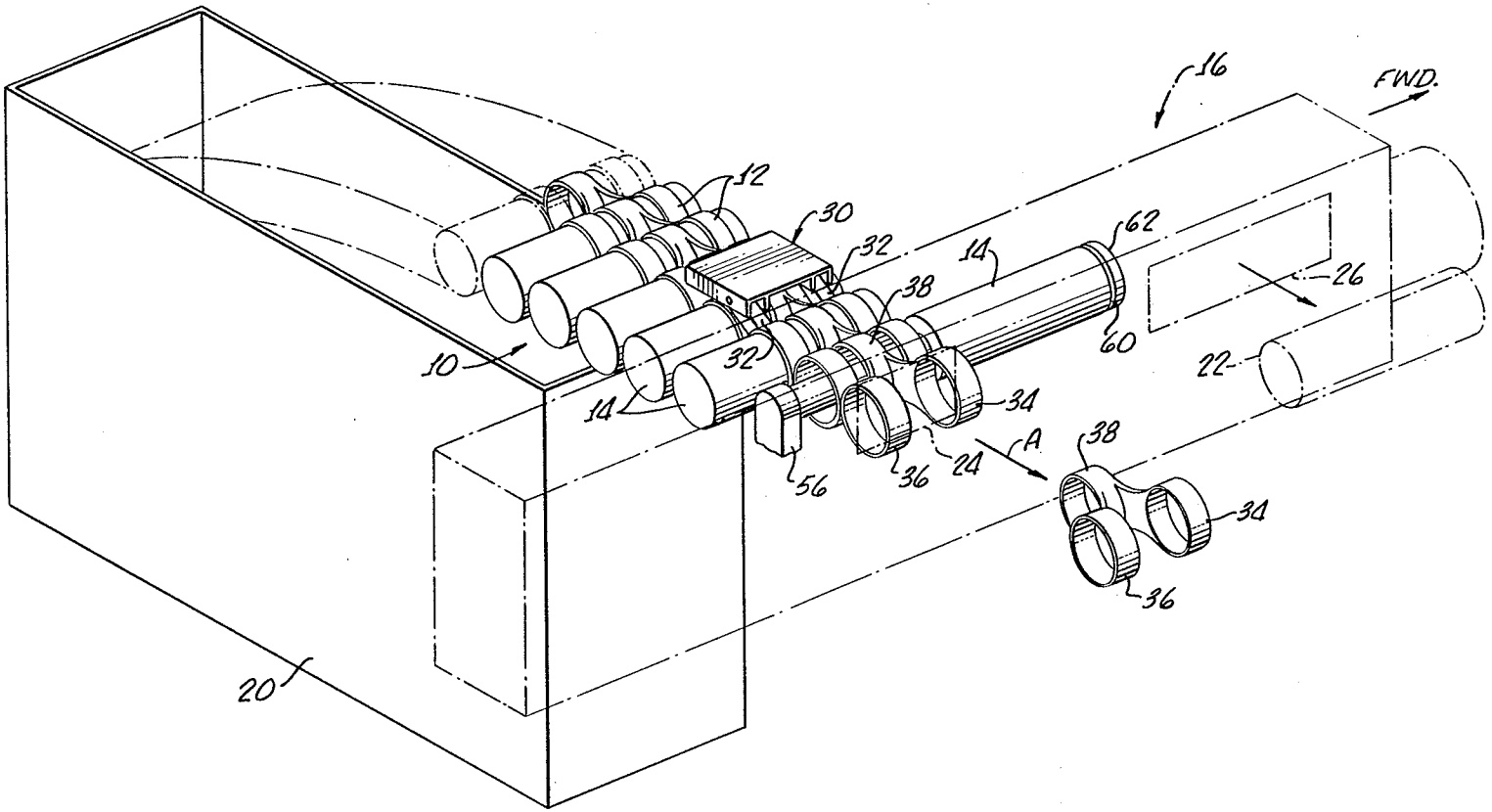
FIG. 1 is a perspective drawing showing a disintegratable ammunition belt constructed of belt links in accordance with the present invention, and shown in operative feeding relationship with an associated gun.

Shown generally in FIG. 1 is a disintegratable ammunition belt 10 which is constructed from a number of individual belt links 12, adjacent ones of which are interconnected by shells 14. Ammunition belt 10 is shown, by way of illustrative example, in operative, feeding relationship with an associated automatic gun 16, (shown in phantom lines), several folds of the belt 10 being contained within an ammunition box 20. As further shown in FIG. 1, in response to firing of gun 16, an individual link 12 and a fired shell casing 22 are ejected through respective gun ejection ports 24 and 26, belt 10 being drawn into the gun by a reciprocating feeding slide 30 which is caused to move outwardly over the belt in response to firing of the gun, retracting pawls 32 mounted on the slide push against one (or more) links 12 as the slide returns, (under spring tension) towards the gun (direction of arrow "A").

Figure 2:
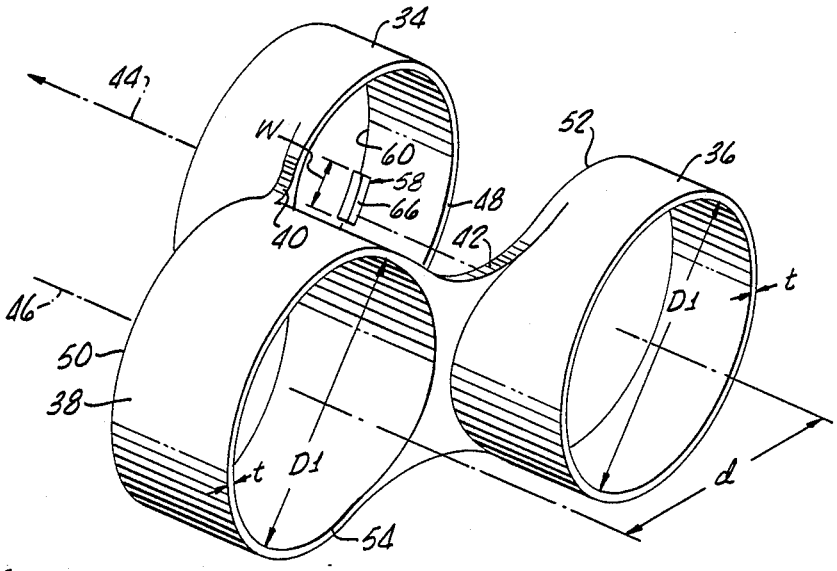
FIG. 2 is an enlarged, perspective drawing of one of the belt links of FIG. 1 showing construction thereof.
Figure 3:
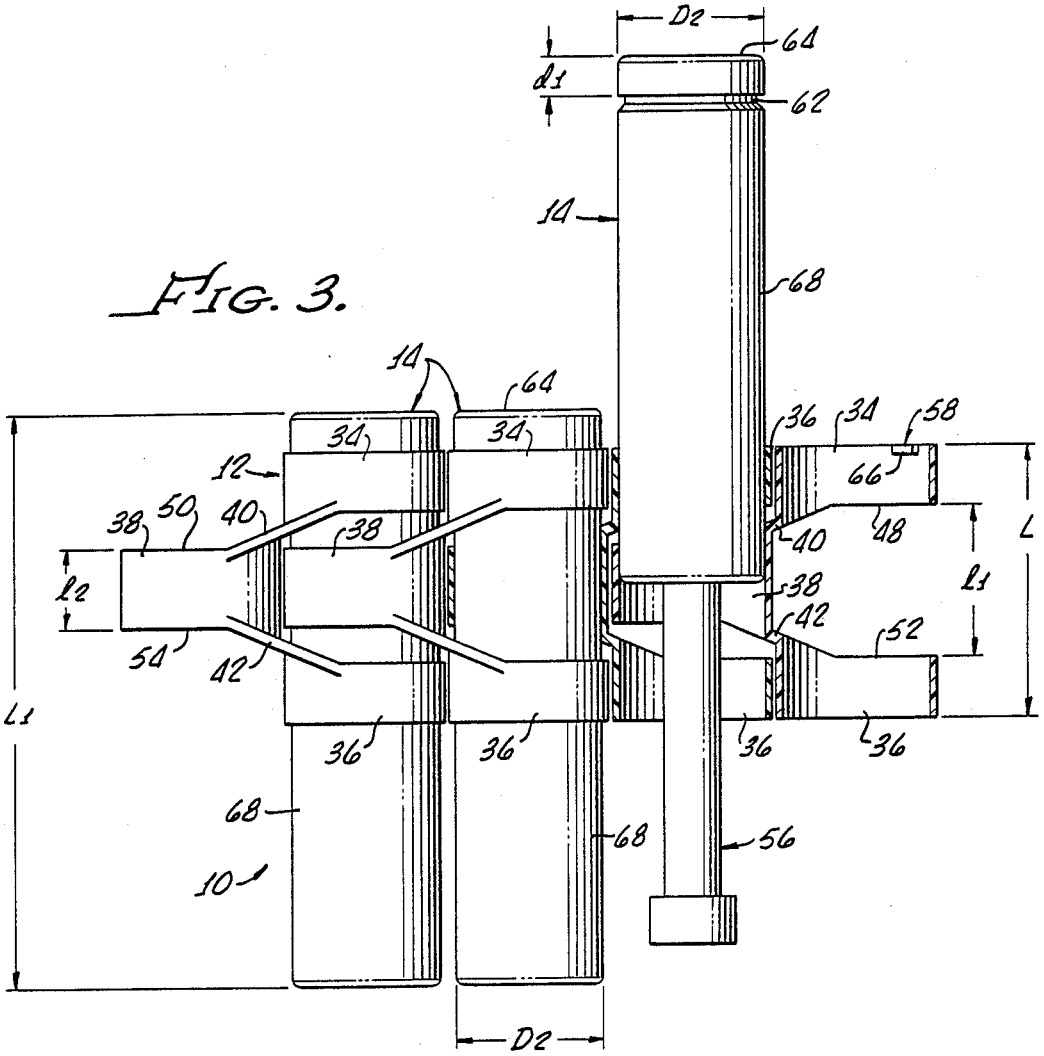
FIG. 3 is a plan view, taken generally along line 3—3 of FIG. 1, showing a plurality of belt links interconnected with cylindrically shaped shells and showing forward removal of a shell from two adjacent links.

Belt link 12 comprises, as best seen in FIG. 2, respective first, second and third elongate, tubular shell holding rings 34, 36 and 38 having an inside diameter, $D_1$, which is slightly greater than the outside diameter, $D_2$, of shells 14 (FIG. 3). First and second webs 40 and 42 interconnect rings 34, 36 and 38 so that first and second rings 34 and 36 are axially aligned on a first longitudinal axis 44 and third ring 38 is on a second longitudinal axis 46 which is parallel to, and spaced apart a distance "d" from the first axis, such axis separating distance, "d", being slightly greater than one shell outside diameter, $D_2$, so as to enable one shell 14 to be inserted into first rings 34 and 36 at the same time as another one of the shells is inserted into third ring 38, as more particularly described below.

First web 40 interconnects first and third rings 34 and 38 at annular end surface 48 of first ring 34 and an annular end surface 50 of third ring 38. Similarly, second web 42 interconnects second and third rings 36 and 38 at an annular end surface 52 of second ring 36 and an annular end surface 54 of third ring 38. End surfaces 48 and 52 of first and second rings therefore face one another and are separated by a distance "$1_1$", (FIG. 3).

To enable interdigitating of links 12 with one another to form ammunition belt 10, the separation distance, $1_1$, between facing surfaces 48 and 52, first and second rings 34 and 36 is made at least slightly greater than a maximum axial length, $1_2$, of third ring 40 (FIG. 3). Ammunition belt 10 is then assembled by fully inserting third ring 38 of one link 12 between first and second rings 34 and 36 of a next link, aligning the three rings and inserting a shell 12 into all three rings. Belt assembly continues in such manner until a desired length is attained. It is seen that each shell 14 contained in belt 10 holds two adjacent links 12 together and that, for example, the removal of the endmost shell by shell ramming portion 56 (FIG. 1) of gun 16 disengages the end link from the next-to-the-end link so that the end link can be ejected or discharged from gun port 24 (FIG. 1).

By constructing each link 12 so that separation distance, $1_1$, between first and second rings, 34 and 36 is at least slightly greater than maximum length, $1_2$, of third ring 38, when belt 10 is assembled in the above-described manner, adjacent links are enabled to hinge relative to one another, about the shell 12 that holds the two links together. This enables the belt to be folded back on itself for space-efficient ammunition storage. In this regard, the projecting end of third ring 38 (remote from ring interconnecting webs 40 and 42) is made sufficiently shorter than length, $1_2$, so that during such link hinging action, ring 38 of one link 12 does not bind against webs 40 and 42 of the adjacent link when the belt is folded for storage.

Some amount of flexibility of links 12, is ordinarily desirable to enable limited fanning and twisting of the assembled belt 10. Some belt fanning and twisting may, for example, be needed to accommodate relative movement between gun 16 and ammunition box 20, and the amount of fan and twist required may therefore, depend upon particular gun system specifications. In general, the amount of the belt fanning and twisting cumulatively provided by involved links 12 should be sufficient to prevent binding of belt 10 in gun 16 and/or in feeder slide 30 throughout the full range of allowed gun movement so that reliable shell feeding occurs. On the other hand, links 12 should not be so flexible as to permit excessive belt fanning or twisting which could cause belt kinking, with resulting belt misfeeding into gun 16.

As can be appreciated, the twisting and torsional flexibility of links 12 depends upon many such factors as the material from which the links are formed, the size of the links, wall thickness, t, of rings 34, 36 and 38, length and configuration of ring interconnecting webs 40 and 42, overall axial length, L, of the links relative to length, $L_1$, of shells 14 and of separation distance, $1_1$, between rings 34 and 36 relative to axial length $1_2$ of third ring 38. As an illustration, increased fanning and twisting of belt 10 can be provided by selecting a more flexible material from which links 12 are constructed, by reducing ring wall thickness, t, and/or increasing the length and flexibility of interconnecting webs 40 and 42.

Each of rings 34, 36 and 38 have a same inside diameter, "$D_1$", which is slightly greater than the outside diameter "$D_2$", of shells 14, thereby enabling the shells to slide relatively freely into and out of the rings. The retaining, of shells 14 in belt link 12 (that is, in rings 34, 36 and 38) thus preferably does not entirely depend upon the tightness of the shells in the link rings. Instead, shells 14 are positively retained in links 12 by a small, radially inwardly projecting detent or tab 58 which is joined to, or formed on, at the forward end of first ring 34, adjacent an annular forward ring surface 60.

Detent 58 is shaped to engage an annular groove 62 formed into the periphery of shells 14 a distance, "$d_1$", rearwardly of a forward shell end 64 (FIG. 3) and may be beveled in a manner enabling the detent to ramp up out of groove 62 in response to axial movement of the shell in at least the forward axial direction. Width "w", (in a circumferential direction) of detent 58, as well as angle of bevel and material flexibility, is selected, relative to shape of shell groove 62, so that a predetermined axial ramming force is required to push the shell forwardly out of the rings.

Belt link 12 is constructed of a sufficiently resilient or flexible material which provides spring action of detent 58 causing the detent to snap into locking relationship with shell groove 62 when a shell 14 is forwardly inserted into rings 36 and 38. Link material and configuration, however, allows detent 58 to flex outwardly (temporarily deforming ring 34) so that an inner beveled detent surface 66 slides along shell outer surface 68, during shell insertion, without causing damage to either the link ring or the detent or to the shell being inserted into link 12.

It is desirable that links 12 be light in weight and low in cost, while at the same time being relatively strong and resistant to deterioration under worst case storage and field use conditions for long periods of time. For such purposes, links 12 may advantageously be injection molded from a strong, tough thermoplastic material such as LEXAN brand thermoplastic. Alternatively NYLON brand plastic or TEFLON brand plastic may be used.

By way of specific example, with no limitations intended or implied, the following link configuration may be provided for holding telescoped 50 caliber shells 12 which have an overall length, $L_1$, equal to about 3.5 inches and which have an outside diameter, $D_2$, of about 1.0 inches. Overall axial length, L, of links 12 may be about 1.75 inches, rings 34 and 36 may each be about 0.375 inches in axial length, and third ring 40 may have a minimum axial length of about 0.40 inches. Wall thickness, t, of rings 34, 36 and 38 may be about 0.040 inches and ring inner diameter, $D_1$, may be about 1.005 inches. Separation distance, d, between ring axes 44 and 46 may be 1.10 inches. Width, w, of detent 58 may be about 0.25 inches, the detent projecting about 0.040 inches from an inner surface 66 of ring 34. The angle of bevel of surface 66 of detent 58 is preferably about 30°. Thickness of webs 40 and 42 may be about 0.10 inches. Links 12 may be constructed of type 141 LEXAN brand thermoplastic.

Although there has been described above a specific arrangement of ammunition belt links and ammunition belts constructed therefrom, particularly for telescoped ammunition, in accordance with the invention for purposes of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A belt of linked ammunition, comprising:

(a) a plurality of telescoped cylindrical ammunition shells each having an annular recess formed in the cylindrical surface thereof adjacent the forward end thereof;

(b) a plurality of plastic links interconnected by said cylindrical shells;

(c) each link having (i) first, second and third rings, (A) each ring defining a smooth cylindrical interior surface of the same interior diameter, said interior diameter being in excess of the exterior diameter of the cylindrical ammunition shells, whereby the shells may be pushed forward through the rings without the rings binding thereon, and (B) the first ring of each link terminating at its forward extremity in a forward facing annular surface; and (ii) web means connecting and spacing the rings of the link, such that the first and second rings are spaced apart on one side of the web means and have a common axis for their interior cylindrical surfaces, and the third ring is disposed centrally on the other side of the web means, with the interior cylindrical surface thereof being axially parallel to and at a spaced apart location from the common axis of the first and second rings;

(d) the third ring of each link fitting between the first and second rings of each adjacent link in the belt so as to provide an interior surface in registration with the interior surfaces thereof;

(e) the plural links being interconnected into a belt by the interposition of the cylindrical ammunition shells within said registered cylindrical surfaces of the rings of adjacent links; and (f) each link having detent means protruding from the cylindrical interior surface of the first ring of the link, said detent means being disposed adjacent the forward facing annular surface of the first ring, and being in engagement with the annular recess formed in the surface of the associated cylindrical ammunition shell, whereby the ammunition shell can be rammed forward out of the links without producing excessive distortion of the plastic links and consequent binding of the shell by the links.

2. The belt of claim 1 wherein the detent means comprises a relatively small upstanding tab which protrudes radially inward from the cylindrical interior surface of the first ring.

3. The belt of claim 2 wherein the tab is beveled on its surface interior of the first ring so as to facilitate loading and pushing of the associated ammunities round through the registered rings of the links.

4. The belt of claim 3 wherein the annular recess is beveled in the same direction as the tab on the first ring of the associated link, to facilitate loading and pushing of the associated ammunition round through the links.

5. The belt of claim 1 wherein each ring further defines a smooth cylindrical exterior surface, of a common exterior diameter.

6. The belt of claim 5 wherein the web of each link extends from the exterior cylindrical surface of the first and second rings to the exterior cylindrical surface of the third ring.

7. The belt of claim 6, wherein the axial length of the portion of the third ring opposite the web is sufficiently reduced from the separation distance between facing surface of the first and second rings, to fit between, and thereby prevent binding of the third ring on, the web of the adjacent link extending from the exterior cylindrical surface of the first and second rings to the exterior cylindrical surface of the third ring.

* * * * *